United States Patent [19]

Miller et al.

[11] 4,280,671

[45] Jul. 28, 1981

[54] GRIPPER MECHANISM FOR TENSION REEL MANDREL AND THE LIKE

[75] Inventors: Paul W. Miller, Warren; Norman H. Fobes, Cortland, both of Ohio

[73] Assignee: Wean United, Inc., Pittsburgh, Pa.

[21] Appl. No.: 153,648

[22] Filed: May 27, 1980

[51] Int. Cl.[3] ..... B21C 47/06; B65H 75/18

[52] U.S. Cl. ..... 242/78.3; 242/72.1

[58] Field of Search ..... 242/78.3, 74, 72.1, 242/72 R, 74.1

[56] References Cited

U.S. PATENT DOCUMENTS

| | | | |
|---|---|---|---|
| 2,920,837 | 1/1960 | Wingard | 242/72.1 |
| 3,061,224 | 10/1962 | Herr | 242/72.1 |
| 3,840,197 | 10/1979 | Rodach | 242/78.3 |
| 4,078,739 | 3/1978 | Noe | 242/78.3 X |

*Primary Examiner*—Edward J. McCarthy

*Attorney, Agent, or Firm*—Daniel Patch; Suzanne Kikel

[57] ABSTRACT

A reel with an expandable mandrel support device for coiling material such as flat rolled steel strip or strips, the reel mandrel having a gripper mechanism for effectively securing each leading end to the reel mandrel which mechanism has numerous cam action gripper bars that singularly can increase gripping force as the tension in the strip strands clamped by one or more cams is developed by the reel; a positioning wedge assembly for these gripper bars constructed to first position and hold immovable, in an operative position, except for movement due to tension buildup, and secondly to positively and quickly release all gripper bars from the strand ends and hence from the reel mandrel when the coils formed by the reel mandrel are to be removed.

14 Claims, 8 Drawing Figures

GRIPPER MECHANISM FOR TENSION REEL MANDREL AND THE LIKE

While the present invention may be employed in various applications where it is desirable or necessary to quickly secure to and release from a holder an external member or members for the purpose of description its application to an expandable rotatable tension reel for winding flat rolled steel strips into coils has been selected. In such applications since the gripper mechanism must be mounted in the outer portion of the reel, usually in one of the expandable segments where space is at a premium and the required support structure is at a minimum, much difficulty has been experienced in the past in developing an effective and reliable gripping mechanism.

As applied to such tension reels, but, without the intention to be limited to such use, the invention relates to and solves the problem of retention by the mandrel of a tension reel, all ends of a multiplicity of flat rolled metal strands that are to be formed into individual coils by the reel.

In particular, it relates to a gripper mechanism of new and unique design for mounting in the outer segment or segments of the reel mandrel which will positively retain the end of each and every strand of steel strip during the total coil formation process, and positively release these ends upon reel mandrel collapse.

It is a well known fact, in metal rolling of flat rolled steel strips, that variation in thickness of metal across the width of the strip, of as much as 3% of nominal metal thickness, is common and commercially acceptable.

This thickness variation across the strip, even in very wide strip, presents less problems for end retention and winding into coil form when the full "as rolled" strip width is coiled.

Reels with automatic expanding mandrels having simultaneous and automatic gripper or release function, and with automatic accommodation to nominal strip gauge, are common and presently enjoy a degree of success in the metals processing industry. Such gripper mechanisms have been of various design and usually are mounted in a cavity formed in one or more outer segments of the reel mandrel.

However, the variation in thickness across the width of the strip, when the strip is divided by slitting into a number of narrow bands or "mults", present operational problems to gripper mechanism of present design.

It is an object of our invention to provide a gripper mechanism that will clamp one, several or multiple strands of flat rolled metal to be wound into coil form to the mandrel of a reel. These strands will each be clamped for winding even though the thickness of any strand may vary from that of any or all other strands, or the thickness may vary within the strand.

It is a further object of the invention that this gripper mechanism be capable of mounting in a closable cavity formed in an expandable segment of the reel mandrel, and be automatically operable upon expansion or collapse of the mandrel.

It is another object of the invention that the movable clamping member of the mechanism be formed from a number of self-articulating bars so designed that upon movement of one or any of the clamped strand ends, the clamping bars will rotate in a manner that will increase clamping pressure and prevent further movement of the metal strand. The clamping areas of these bars are generated as spiral cams that will, upon rotation, increase clamping force and will not loosen due to vibration.

It is a further object that the anvil for all these articulated clamping bars be a wall forming a limit of the cavity within the expandable segment in which the total gripper mechanism is mounted, and that the cavity, so formed in one of the mandrel segments, be made to such dimension as to accommodate the total gripper mechanism and that this cavity, after such accommodation, be capable of being closed by a heavy mechanical member that will protect the gripper mechanism from the dangerous forces inherent in the operation and will provide an exterior surface contour that will be a continuation of the mandrel contour and will have the mechanical strength requirements needed to support the coil formed on the reel mandrel.

A still further object of the present invention is to provide in combination with a rotatable reel for coiling in a side-by-side fashion a number of bands formed from rolled steel strip in which one or more of said bands may have different cross sectional thicknesses as compared with other said bands being coiled, a gripper mechanism for gripping said bands to said reel, said reel including a container means and having an opening, said gripper mechanism adapted to be received in said opening in a manner to form a gripping slot for the ends of said bands with another cooperative member, said cooperative member forming a holding surface for the gripping of said bands, said gripping mechanism comprising a plurality of displaceable gripper bar means, means received in said opening to move said gripper bar means as a unitary assembly into and out of a gripping position relative to said cooperative member, each said gripper bar means being constructed and supported so as to be capable of independent movement relative to other of said gripper bar means under the pull of one or more bands gripped thereby to cause an increase in the gripping force on said one or more bands by said independent movement.

These objects as well as other features and advantages of the present invention will become better understood when the following description of a preferred embodiment thereof is read along with the accompanying drawings of which:

Figure 1:
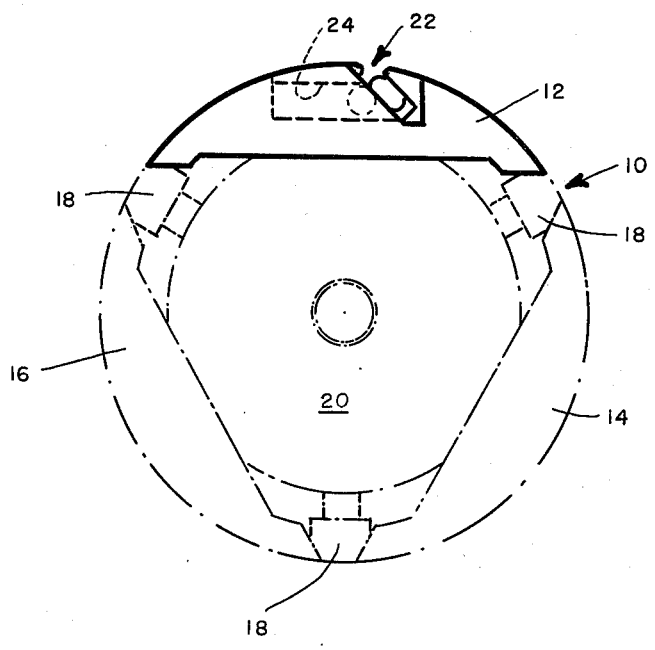
FIG. 1 is an end view of a well known tension reel for coiling cold steel strip showing in one of the segments thereof the incorporation of a preferred embodiment of a gripping mechanism constructed in accordance with the teaching of the present invention.

With reference first to FIG. 1, a three segment reel 10 of a generally well known construction, is illustrated in which its segments are identified at 12, 14 and 16. The segments are expanded and collapsed by wedge assemblies 18 which are mounted in the arbor 20 of the reel. It is the segment 12 shown in bold lines that is of particular importance because it is in this segment that the novel gripping mechanism 22 is incorporated.

Formed to extend along the longitudinal or major axis of the segment 12 as one views FIG. 1, is an opening 24 which extends as to its longitudinal sides parallel to the aforesaid longitudinal axis of the segment. The opening, rectangular in general shape forms upper and lower straight parallel guiding surfaces 26 and 28 for the moveable parts of the gripping mechanism 22 which in total is received in the opening.

Figure 2:
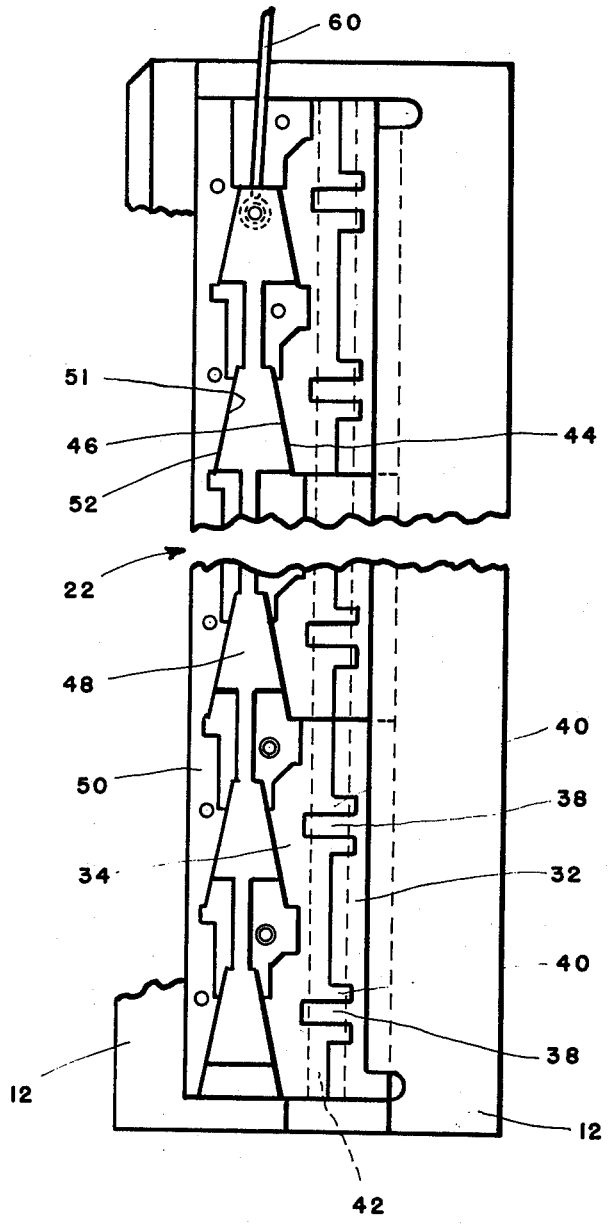
FIG. 2 is a broken away sectional plan view of the gripping mechanism illustrating FIG. 1.
Figure 3:
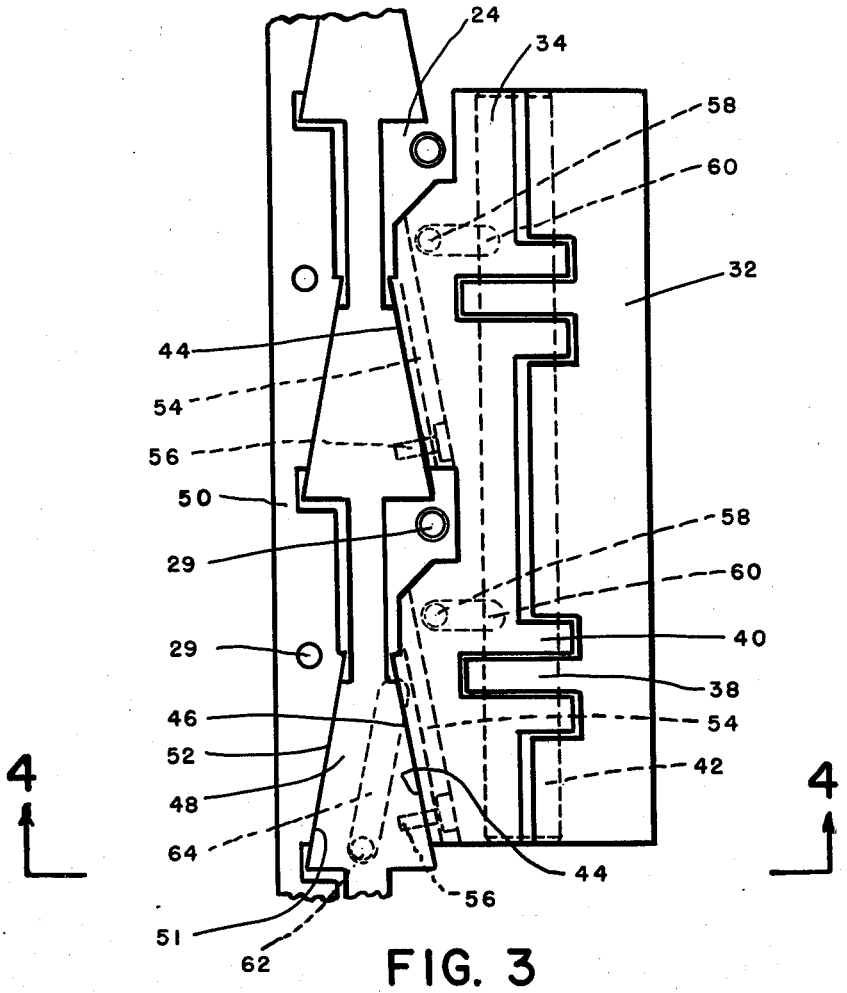
FIG. 3 is an enlarged view of a portion of FIG. 2, illustrating the parts in a non-gripping position.
Figure 4:
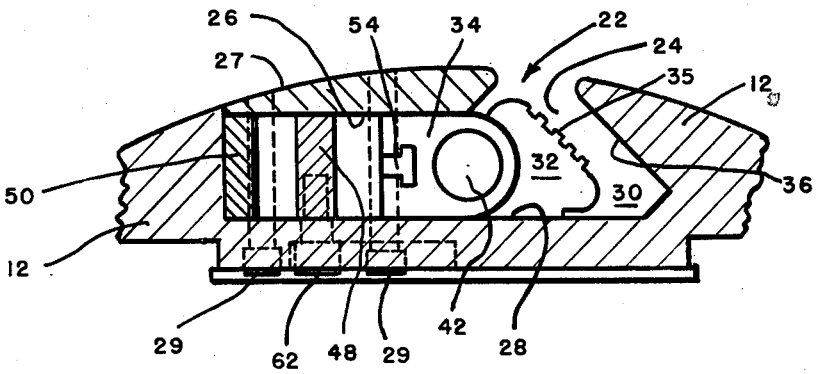
FIG. 4 is a sectional view taken on lines 4—4 of FIG. 3.

FIGS. 2–4 illustrate more clearly the construction of the gripping mechanism 22 and its relationship to the segment 12. Since FIG. 4 is an enlarged view, although in section similar to the showing of segment 12 in FIG. 1, reference will be made first to this figure where the opening 24 is shown formed in the segment 12 which received the gripping mechanism 22. As already noted, the opening has parallel retaining surfaces 26 and 28 which are engaged by adjacent parts of the gripping mechanism, the upper surface 26 being formed by a separate piece 27 of the segment which is secured to the segment by bolts 29, and capable of protecting the gripper mechanism from the dangerous forces inherent in the operation. Moreover, it will provide an external surface contour that will be a continuation of the mandrel contour, and possess the mechanical strength requirements needed to support the coil formed on the mandrel.

The opening 24 at the left as one views FIG. 4 has an enlarged portion that forms a material receiving slot 30, the depth of which is great enough to provide the necessary contacting area and limits the extent to which the material can enter the slot.

A clamping anvil surface 36 is arranged geometrically within the mandrel so that a straight line projection of the surface will form an angle of about 45° with a line tangent to the mandrel's circular face at the point where the projected line and the tangent intersect. When the reel mandrel is collapsed there is provided an entry slot in the gripper mechanism that when this slot is measured perpendicular to the gripping surface it will dimensionally be substantially greater than the maximum strip thickness to be clamped and approximately three times such thickness.

The gripping mechanism itself includes a number of similarly constructed gripper bars 32 rotatably secured on a common horizontal axis to a wedge assembly 34, the latter being contacted by the guiding surfaces 26 and 28 while the gripping bar is only engaged by the surface 28, so that its outer surface 35, has a gripping area that forms with an opposite clamping surface 36 two cooperative holding members for the band or bands. The curved form of each of the bars 32 allows on counter-clockwise rotation its gripping surface 35 to be displaced into the slot 30 to close the gap between itself and the surface 36.

The cam development must be such that the line of action of the clamping force must always pass through or inside the center of rotation of the cam. Such a cam has a contact surface generated as a spiral from the center of rotation wherein the clamping surface is always tangent to the plane surface clamped and is, therefore, self-tightening and locking.

Each bar 32 is provided with projecting bored and fitted bosses, 38, at its inner side seen best in FIGS. 2 and 3 to allow in cooperation with similar bored bosses 40, a common hinge pin 42 to be used to connect each gripper bar 32 to the wedge assembly 34. FIG. 3 illustrates that the wedge assembly 34 at its rearward side is formed with wedge surfaces 44, which engage similar wedge surface 46 formed on a wedge bar 48. The wedge bar in turn is contacted by a backup wedge member 50, also having wedge surface 52 which engages corresponding wedge surface 51 provided on the wedge bar 48 as illustrated in FIG. 3. The elements 34, 48 and 50 form a rectangular shaped assembly which is received in the opening 24 and the elements 34 and 48, are guided by the surfaces 26 and 28 and pin elements 58 thereby causing the gripper bars 32 to be forced toward or away from the gripping surface 36 as a unit. In order to provide a rigid mechanism for holding the gripper bars 32 to withstand the total gripping force, without reliance on a power means of great magnitude the wedges of the arrangements 34, 48 and 50 are formed with similar angles that are or proximately are self-locking when the wedge surfaces have a proper coefficient of friction, mathematically determinable. This self-locking condition of the wedges prevents any movement of the wedge bar due to the transmission of any magnitude of clamping force from the strip through the articulated gripper bars or structure. In the design illustrated this angle is approximately 11°.

It is important to note certain other interconnection relationships involving the elements 32, 34 and 48. Each wedge surface 44 of the wedge assembly 34 is provided with a "T" shaped slot 54 for receiving a "T" shaped member 56 which causes the positive retraction of the gripper bars 32 from their operative gripping position (FIG. 6) to their open or inoperative position (FIG. 4) when the reel mandrel is collapsed and hence the wedge bar 48 is retracted.

Gripper assembly, parts 34, 42, and 32, FIG. 4, are forced to move in the gripper open to gripper closed position plane by guide pins 58, FIG. 3, which are secured into gripper assembly, part 34, and are free to slidably move in T slot 60 provided in the bottom surface of segment 12, FIG. 4. During movement, the wedge action results in a force component in the plane at right angles to the gripper open to gripper closed plane resisted by the pins 58, so that movement in the gripper open/close plane only is possible.

A construction similar to that above is used for constraining the movement of wedge bar 48, FIG. 3, to the coplaner movement required of this bar. Pins 62 fixed into wedge bar 48 move in T slots 64 which are provided in the bottom surface of segment 12, FIG. 4. The T slots 64 are machined so that exact parallelism of slot to pin guide surface with wedge surface 52 of fixed wedge 52 is achieved. The slope of the T slot 64 relative to the long axis of the wedge bar 48 determines the direction and magnitude of the movement required of gripper assembly 34 and wedge bar 48.

The double wedge design of wedge bar 48 allows relatively large movement of the gripper means assembly in the gripper open to gripper closed plane for a relatively smaller movement of wedge bar 48. By adapting the wedge angle of wedge bar 48, to the required movement of the gripper means and to the stroke required for expanding or collapsing the reel mandrel within available segment cavity space, large gripper means movement can be achieved while maintaining shallow wedge angle. The resulting wedge angle for most applications can be self-locking when employed with lubricants chosen to produce the required co-efficient of friction. It will be noted in FIG. 2 that the gripper bars 32 are made in sections whereas the other parts of the gripper means assembly 34 and 42 and wedge bar 48 and back up wedge 50 are each one piece construction. The multiplicity of gripper bars provide the important feature of allowing a single gripper bar 32 to engage one or several metal strands with an effective gripping force even though this one or several strands may have non-uniform thickness or the one or several strands singularly gripped may have a relatively great thickness variation from other metal strands gripped by other of the multiplicity of bars of the total gripper means.

As previously noted, the gripper bars 32 are made to be self-articulating upon outward movement from slot 30 of any of the clamped strands. This articulation in the form of rotation of bar 32 about pin 42 results in an increase in gripping force by any gripper bar rotated so that further outward movement of the strand or strands is prevented.

The movement of the wedge 48 can be accomplished in a number of different ways known to the art. For example, the rod end 66 of the bars shown in FIG. 2 can be secured to a separate power source such as a piston cylinder assembly, not shown, or be tied directly to a moving part of the expanding reel mandrel through a pull-push rod. This latter action is the preferred way of accomplishing the movement of the gripper bar, since it ties gripper means movement to the collapsing and expansion of the reel and correlates these functions.

Figure 5:
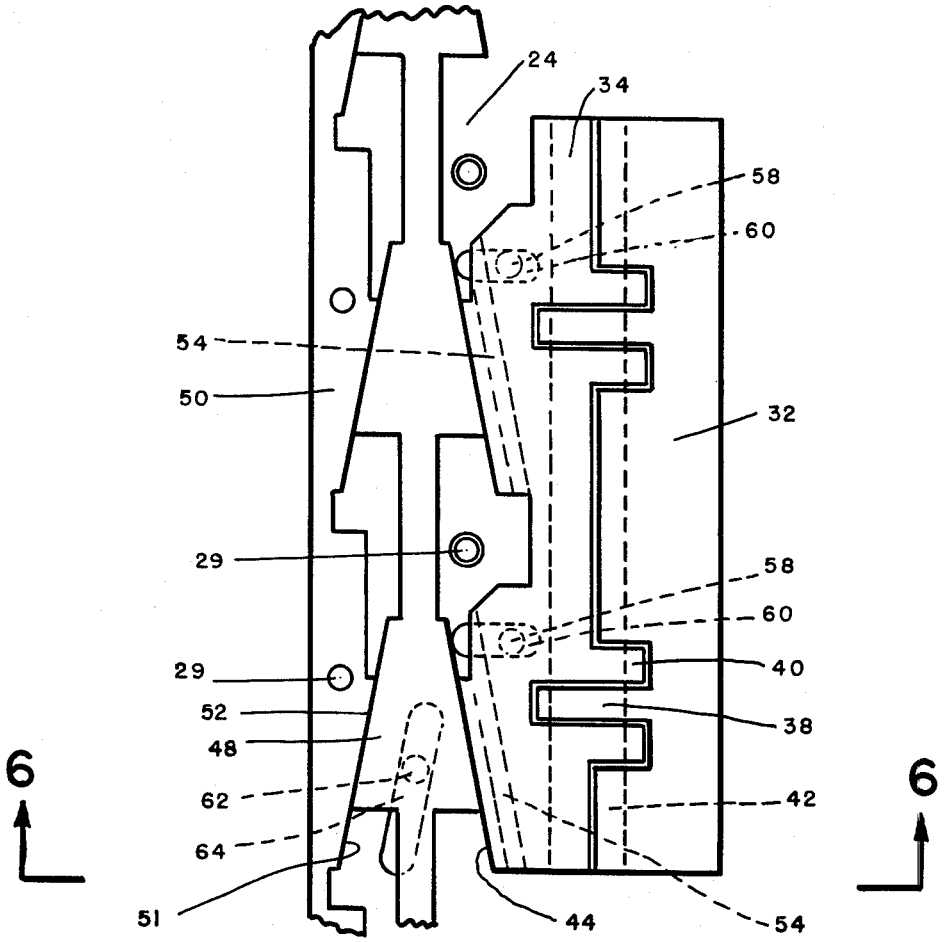
FIG. 5 is a view similar to FIG. 3 illustrating the parts in their gripping position.
Figure 6:
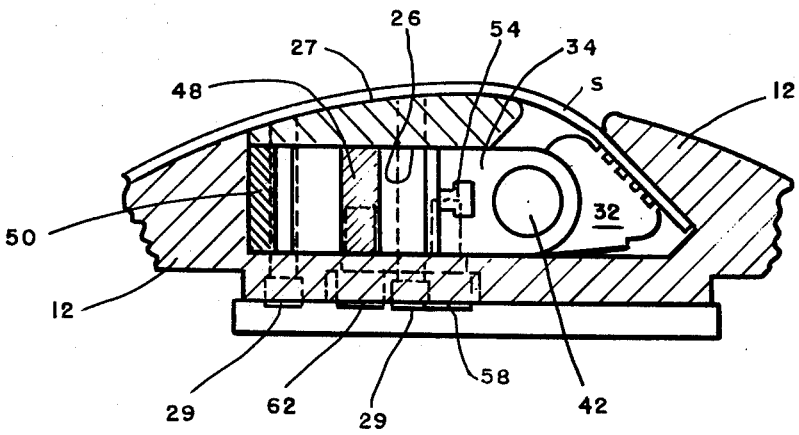
FIG. 6 is a sectional view taken on lines 6—6 of FIG. 5.

A feature that is important to observe in connection with the above described embodiment is the design of the wedge mechanism that results in positive, rigid and un-yielding positioning of the gripper bar in a design where space and support structure are minimum as shown in FIGS. 5 and 6. In this position should one of several strands tend to move out of the slot 30 while held by the gripper bars 32, the bar or bars will rotate causing movement of the lower portion thereof in the lower portion of the band, thereby progressively increasing its gripping force as a function of movement of the band while the wedge action will hold the gripping bar rigid in its operative position. When it is desired to retract the bars as a unit the wedging action coupled with the interlocking of members 32, 34 and 48, will cause a positive releasing force to be developed against the bar allowing for a quick and dependable release of the material and full opening of the gripper assembly.

Figure 7:
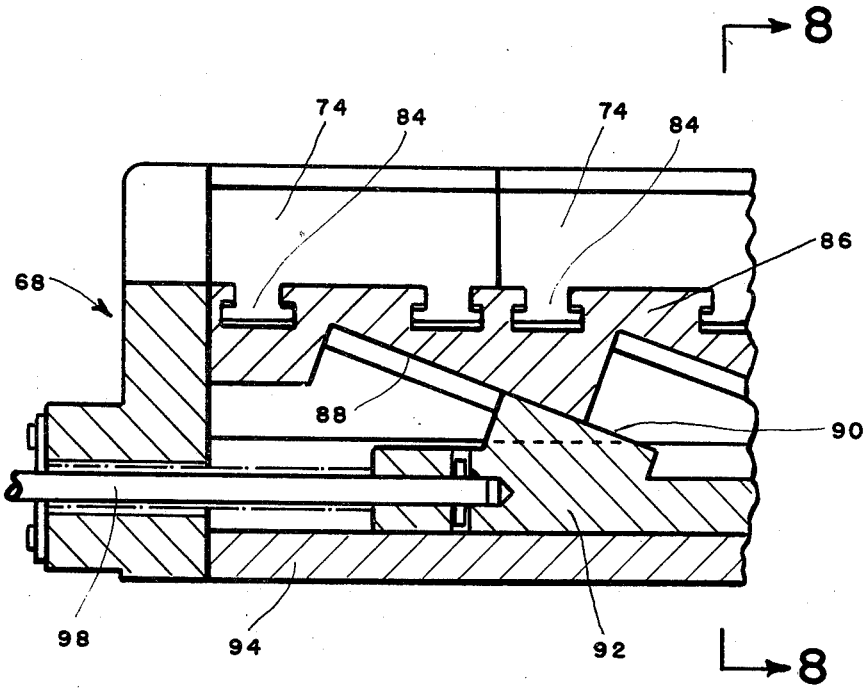
FIG. 7 is a partial sectional view of a second embodiment of the present invention.
Figure 8:
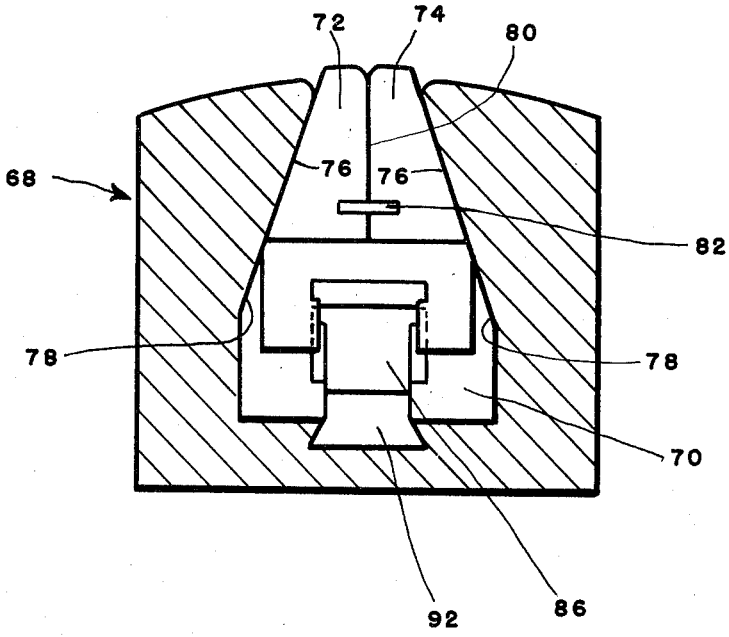
FIG. 8 is a modified sectional view taken on lines 8—8 of FIG. 7.

In now referring to FIGS. 7 and 8 which as noted before, illustrate a second embodiment of the present invention, it is to be understood that the remarks made above concerning the construction and operation of the reel and particularly the segment containing the gripper applies to the second embodiment. The segment however, instead of having a rectangular opening is provided with a trapezoidal opening 70 as shown in FIG. 8.

Mounted in the opening 70 are two opposed sectionalized gripper bar elements 72 and 74 having outer similar tapered surfaces 76 which engage complementary tapered surfaces 78 formed by the opening 70. Each section of the gripper bar elements 72 and 74 have opposed inner surfaces 80 which form gripping surfaces for the material. The surfaces 80 are shown in engagement with each other thereby illustrating their gripping, i.e., closed position.

A series of separator springs 82 is arranged between the gripper bars 72 and 74 which provide for a positive action to assure the uniform spreading of the gripper bars 72 and 74 during the opening procedure, thus creating a slot for the receiving of the metal strip. The lower ends of the gripper bar elements 72 and 74 are formed as T-sections, FIG. 7 illustrating this construction for the gripper 74. The T-connections allow the gripper bar elements to be positively, but loosely, connected to a wedge assembly 86 which has a series of wedge surfaces 88 which engage complementary wedge surfaces 90 formed on a wedge bar 92. The T-connections thus described assure the positively closing of the gripper bars 72 and 74 against the metal strip and the slightly loose fit allows for the settling of the wedges against the strip for the initial gripping action as well as allowing individual action of the various gripping sections to compensate for a slight variance in the thickness of the strip. The wedge surfaces of the wedge assembly 86 and the wedge bar 92 are physically held in operational position by restraining shoulders or gibs so that upon retraction of the wedge bar 92, the gripper bars 72 and 74 are retracted.

The wedge bar 92 as shown in FIGS. 7 and 8 is supported along its entire length by a rigid slide surface 94 of the segment 68. A rod 98 shown in FIG. 7 connected to the wedge bar 92, is a link of the mechanism that imparts movement to the bar for effecting the opening and closing of the gripper elements 72 and 74 as previously explained. The cooperating wedges of the second embodiment are designed to be self-locking as described for the first embodiment.

While the design of the second embodiment differs in many respects from the first embodiment, it still incorporates the feature of providing increase in the gripping power on movement of the gripper elements 72 and 74 by the material, a positive rigid positioning of the gripper bar elements and provides a positive retracting force to free the gripper bar elements from the material when the reel is collapsed.

In accordance with the provisions of the patent statutes, we have explained the principle and operation of our invention and have illustrated and described what we consider to represent the best embodiment thereof.

We claim:

1. In combination with a rotatable reel for coiling in a side-by-side fashion a number of bands formed from rolled metal strip in which one or more of said bands may have different cross sectional thicknesses as compared with other of said bands being coiled, a gripper mechanism for gripping said bands to said reel, said reel including a container means having an opening, said gripper mechanism adapted to be received in said opening in a manner to form a gripping slot for the ends of said bands with another cooperative member, said cooperative member forming a holding surface for the gripping of said bands, said gripping mechanism comprising a plurality of displaceable gripper bar means, means received in said opening to move said gripper bar means as a uitary assembly into and out of a gripping position relative to said cooperative member, each said gripper bar means being constructed and supported so as to be capable of independent movement relative to other of said gripper bar means under the pull of one or more bands gripped thereby to cause an increase in the gripping pressure on said one or more bands by said independent movement.

2. In combination with a rotatable reel according to claim 1 wherein each said gripper bar means comprises a separate cam, common means for rotatably supporting said cams in a manner that each cam is free to rotate independent of the others, said cams each having a common center of rotation and a gripping surface generated as a spiral so as to increase the gripping force on rotation of each cam by said pull of the gripped band or bands in a direction outward of said slot in a manner that locks the rotated cam against dynamic loosening forces.

3. In combination with a rotatable reel according to claim 1, said means for moving said gripper bar means as a unitary assembly comprising a wedge assembly means operatively connected to said gripper bar means and constructed and arranged for selective movement in order to effect said unitary movement of said gripper bar means toward and away from said holding surface and for holding said gripper bar means against said unitary movement when once positioned in an operative gripping position and for quickly retracting said gripper bar means from said operative position, and back up means for said wedge assembly means stationarily mounted relative to said wedge assembly means and constructed and arranged to rigidly support said wedge assembly means.

4. In combination with a rotatable reel according to claim 1 including the additional means for expanding and collapsing said reel and for at the same time causing said gripper bar means to move as a unitary assembly into and out of said gripping position.

5. A gripper mechanism for use in gripping an external member such as the leading end of strip-like material being wound on a rotating reel, container means for the gripping mechanism having an opening formed with straight movement restraining surfaces, said gripper mechanism adapted to be received in said opening in a manner to form a gripping slot with another cooperative member for the insertion of said external member into said gripping mechanism, said cooperative member forming a holding surface for the gripping of said external member, said gripper mechanism comprising a displaceable gripper bar means adapted to grip the external member by forcing it against said holding surface, a wedge assembly means operatively connected to said gripper bar means and constructed and arranged for selective movement in order to effect movement of said gripper bar means in said opening toward and away from said holding surface and for holding said gripper bar means against movement when once positioned in an operative gripping position and for quickly retracting said gripper bar means from said operative position, and back up means for said wedge assembly means stationarily mounted relative to said wedge assembly means and constructed and arranged to rigidly support said wedge assembly means along a substantial portion of its length.

6. A gripper mechanism according to claim 5 wherein the wedge of said wedge assembly means is formed with a self-locking angle and constructed and arranged to hold said gripper bar means against movement when in its operative position.

7. A gripper mechanism according to claim 5 wherein said gripper bar means is constructed in a manner, when in its operative position, to move relative to said wedge assembly thereby to reduce the distance between itself and said cooperative member and wherein means is provided for connecting said gripper bar means to said wedge assembly means in a manner that allows said movement when in its operative position under the tendencies of the external material to move out of said slot during the gripping operation, thereby movement of said external material is employed to increase the gripping force of said gripper bar means.

8. A gripper mechanism according to claim 7 wherein said gripper bar includes a rotatable member having a portion that on rotation toward said cooperative members, reduces the space between these two members.

9. A gripper mechanism according to claim 7 wherein a portion of said gripper bar means is formed in the shape of a cam, means for rotatably mounting said cam to a remaining portion of said gripper bar means, said cam having an outer surface for gripping the external material and wherein its lower end relative to said slot has a substantially larger radial dimension from its center of rotation than its upper end, whereby on rotation of said cam during the gripping operation in one direction, the gripping force is increased.

10. In a gripper mechanism according to claim 7 wherein said gripper bar means and said other cooperative member comprises a cooperative pair of gripping blocks having at their inner corresponding sides flat surfaces that form said slot, said outer corresponding sides of said blocks having complementary opposite tapers, each adapted to engage a complementary taper formed by said slot.

11. A gripper mechanism according to claim 5 wherein said gripper bar means is formed by a number of sections along its length in a manner that allows each section to move independently of the others during gripping, thereby allowing each section to exert its own gripping force on corresponding sections of the external material.

12. A gripper mechanism according to claim 11 wherein said gripper bar means and said wedge assembly have a number of cooperative wedges and wherein one or more of said sections of said gripper bar means includes a set of said cooperative wedges.

13. A gripper mechanism according to claim 12 wherein said back up means and said wedge assembly have a number of cooperative wedges and wherein one or more of said sections of said gripper bar means is cooperatively associated with a set of said cooperative wedges of said back up means and of said wedge assembly.

14. A gripper mechanism according to claim 12 wherein the cooperative wedges of said gripper bar means, wedge assembly and said back up means are formed with self-locking angles and constructed and arranged to hold said gripper bar means against movement when in its operative position.

* * * * *